US005983879A

United States Patent [19]

Gifford

[11] Patent Number: 5,983,879

[45] Date of Patent: Nov. 16, 1999

[54] BOW MOUNT AND PROCESS FOR TUNING A BOW

[76] Inventor: Craig N. Gifford, 24649 Narrows Rd., South Bloomingville, Ohio 43152

[21] Appl. No.: 09/100,185

[22] Filed: Jun. 19, 1998

[51] Int. Cl.[6] ..... G01D 21/00

[52] U.S. Cl. ..... 124/1; 124/86; 33/506

[58] Field of Search ..... 33/506; 124/1, 124/23.1, 86; 248/121, 122.1

[56] References Cited

U.S. PATENT DOCUMENTS

| | | | |
|---|---|---|---|
| 2,895,729 | 7/1959 | Sanders | 248/121 X |
| 4,974,576 | 12/1990 | Morey et al. | 124/91 |
| 5,048,504 | 9/1991 | Ballard | 124/23.1 X |
| 5,060,627 | 10/1991 | Fenchel | 124/88 |
| 5,121,736 | 6/1992 | Hawk | 124/86 |
| 5,121,890 | 6/1992 | Komada | 248/122.1 |
| 5,175,937 | 1/1993 | Emerson, III | 33/503 |
| 5,231,971 | 8/1993 | York et al. | 124/90 |
| 5,344,110 | 9/1994 | Scarpa | 248/229 |
| 5,353,511 | 10/1994 | Boll et al. | 33/506 |
| 5,433,186 | 7/1995 | Corwin | 124/1 X |

FOREIGN PATENT DOCUMENTS 2355980 5/1975 Germany .

OTHER PUBLICATIONS

Bow Hunting World, 1988 Buyer's Guide Edition, pp. 13–15.

*Primary Examiner*—John A. Ricci

*Attorney, Agent, or Firm*—Jason H. Foster; Kremblas, Foster, Millard & Pollick

[57] ABSTRACT

A bow mount includes a support member, a frame member, and two clamping arms. The clamping arms are spaced from each other and extend laterally from the front side of the frame member. A bow is secured in the clamping arms. The frame member is then rotated and tilted with respect to said frame member to determine the level conditions of a bow. An arrow is then attached to the bow string and an arrow stabilizer. The arrow rest is then placed and the sight pins are properly aligned.

11 Claims, 18 Drawing Sheets

Front View

Side View

Top View

Front View

Side View

Top View

END VIEW

SECTION "AA"

SIDE VIEW

TOP VIEW

Front View

Side View

Top View

Front View

Side View

Top View

Front View

Side View

Top View

BOW MOUNT AND PROCESS FOR TUNING A BOW

BACKGROUND OF THE INVENTION

1. Field of the Invention

The invention relates to a novel bow mount and process for tuning a bow. More particularly, the invention relates to an apparatus and method which provide sufficient flexibility and adjustability for use with any size or type of bow.

2. Description of the Related Art

In the past, it has been discovered that even premium bows are not always constructed or assembled with perfectly matched components such as limbs, eccentrics, bushings etc. Also, accessories such as arrow-rests or sights may not be precisely constructed or installed on a bow. In order for archers to be able to shoot accurately, they need a bow that has a number of elements precisely aligned and set up. Archers also need to check and adjust their bows, arrows and accessories frequently after the initial set-up. In an effort to alleviate the above difficulties, many bow holder and bow tuning devices have been developed.

An example of one such device is disclosed in Morey et al., U.S. Pat. No. 4,974,576. This device is limited in use to bows that are capable of having a stabilizer in order to fasten a bow to the device. It is also difficult to set up bows with this method because of the swinging of the plumb bob or arrow while attempting to adjust the arrow rest and sight pins. Trying to hold a level in a precise location against an arrow or string is very awkward.

Another example is disclosed in Fenchel, U.S. Pat. No. 5,060,627. This device is limited to certain bows and elements and is therefore capable of only solving a portion of the problems associated with accurate archery shooting. The patent to Emerson, U.S. Pat. No. 5,175,937, is another example that is limited to bows that have two threaded holes in the riser. This device is capable of only solving a portion of the problems associated with accurate archery shooting.

Three other examples that are limited to solving a portion of the problems associated with accurate archery shooting are listed below. The patent to York et al., U.S. Pat. No. 5,231,971, discloses a tool used to attempt to align the arrow with the bow and set the tiller. Accurate settings are difficult without checking other parts and assembly of a bow. An archer's form is not taken into consideration while using this tool. The patent to Boll, U.S. Pat. No. 5,353,511, discloses a device which can only be mounted on bows which have a threaded stabilizer hole located in the riser. Accurate settings can be difficult without support of the bow and arrow while making adjustments. The patent to Scarpa, U.S. Pat. No. 5,344,110, merely discloses an apparatus designed to hold a bow in various positions.

The prior art fails to show any device which can allow a user to place bows of various sizes and shapes in a mount and then perform on the bow all the various measurements and make any necessary changes while the bow remains mounted. The prior art also fails to show any type of device which allows a great flexibility of motion once the bow is mounted in order to ensure that the bow is appropriately positioned. The present invention solves this and other problems not apparent from the prior art.

BRIEF SUMMARY OF THE INVENTION

The present invention is a bow mount having a variety of features. The bow mount includes a support member and a frame member rotatably mounted to the support member.

The frame member has a front side. Two clamping arms are mounted to the frame member and extend laterally from the front side of the frame member, each for clamping a limb of a bow. The clamping arms are spaced from one another. The frame member may also be tiltably mounted to the support member and each clamping arm may be tiltably mounted to the frame member. The frame member may include a plurality of longitudinal sections, each of which are slidably attached to at least one other longitudinal section.

The rotatable mounting of the support member and the frame member may be accomplished by a first pair of mounting members mounted between the support member and the frame member. Each of the first pair of mounting members may have a circular cross-section and may allow for rotation about the center of each of the mounting members. There may also be provided a first clamp capable of securing the first pair of mounting members to each other.

The tiltable mounting of the support member and the frame member may be accomplished by a second pair of mounting members mounted between the frame member and the support member. Each of the second pair of mounting members may have a rectangular cross-section and may allow for a tilting of the support member with respect to the frame member. There may also be provided a second clamp capable of securing the second pair of mounting members to each other.

An arrow stabilizer may be slidably attached to the support member and may be capable of receiving an arrow. The arrow stabilizer may include a bracket and a body slidably attached to each other. The body may include a plate and a holder slidably attached to each other. A third clamp capable of securing said plate to said holder may also be provided. The bracket may include a gauge for determining the correct position for an arrow received in the body.

The process for tuning a bow includes the use of all the pieces noted above. The bow is secured in the clamping arms. A first level is placed on a bowstring on the bow. The frame member is rotated with respect to the support member until the first level indicates a level condition. Then, the frame member is secured to the support member in order to prevent rotation of the frame member with respect to the support member. Second and third levels are placed on the bow. The frame member is then tilted with respect to the support member until the second and third levels indicate a level condition. The frame member and support member are then secured with respect to each other in order to prevent tilting between the frame member and the support member.

An arrow may then be attached to the bowstring and a plate in an arrow stabilizer. A fourth level is attached to the arrow. The holder of the arrow stabilizer is slid with respect to the plate of the arrow stabilizer until the fourth level indicates a level condition. An arrow rest may be attached to the bow where the arrow rest is in contact with the arrow.

The arrow may be detached from the bow string and the plate may be slid until the arrow is substantially in line with sight pins attached to the bow. The arrow may then be reattached to the bow string and the sight pins may be adjusted until the sight pins are centered with respect to the arrow.

Figure 1A:
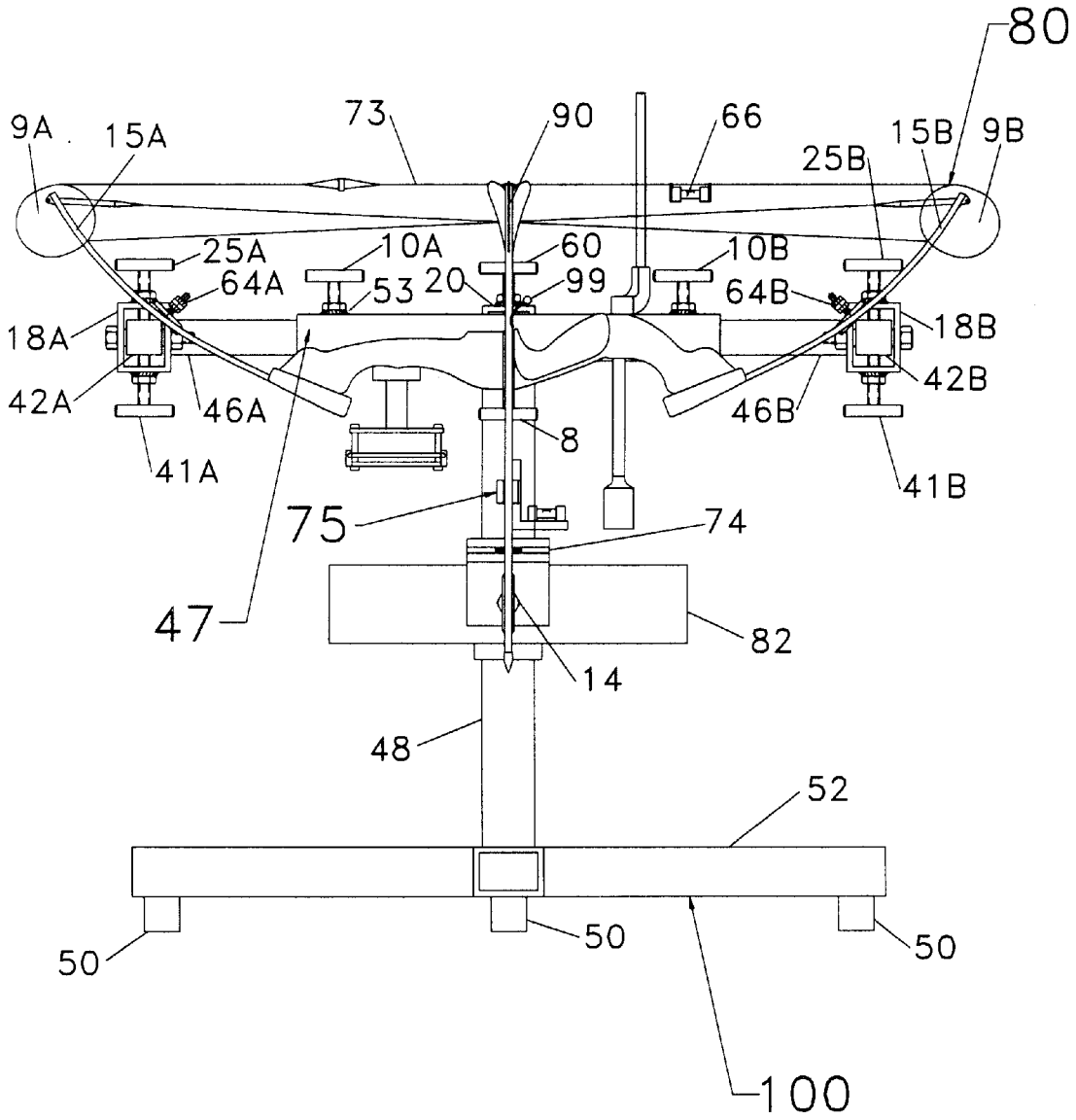
FIG. 1A is a front view of the invention illustrating a bow and arrow attached.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION OF THE INVENTION

Figure 1B:
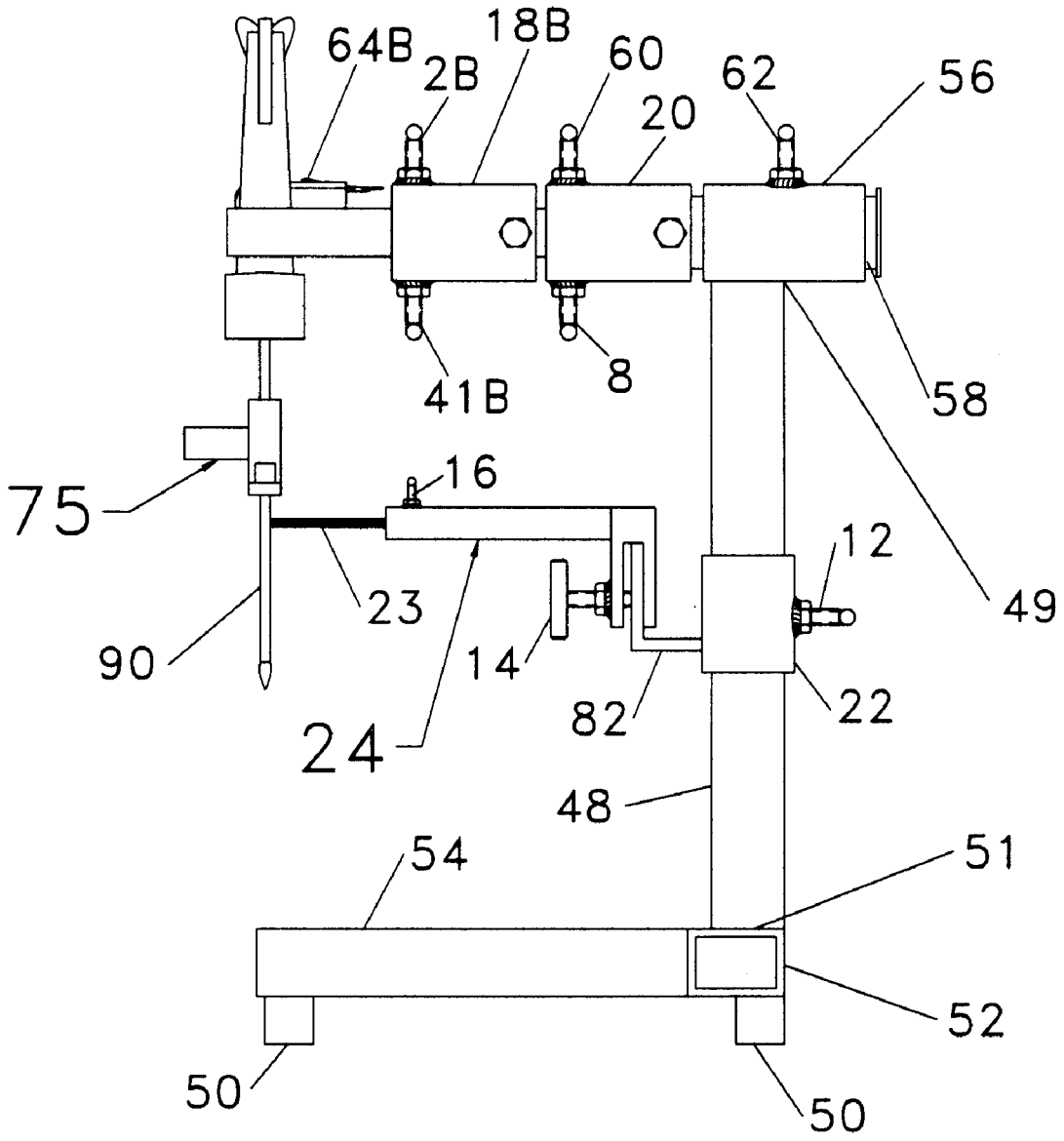
FIG. 1B is a side view of the invention illustrating a bow and arrow attached.
Figure 1C:
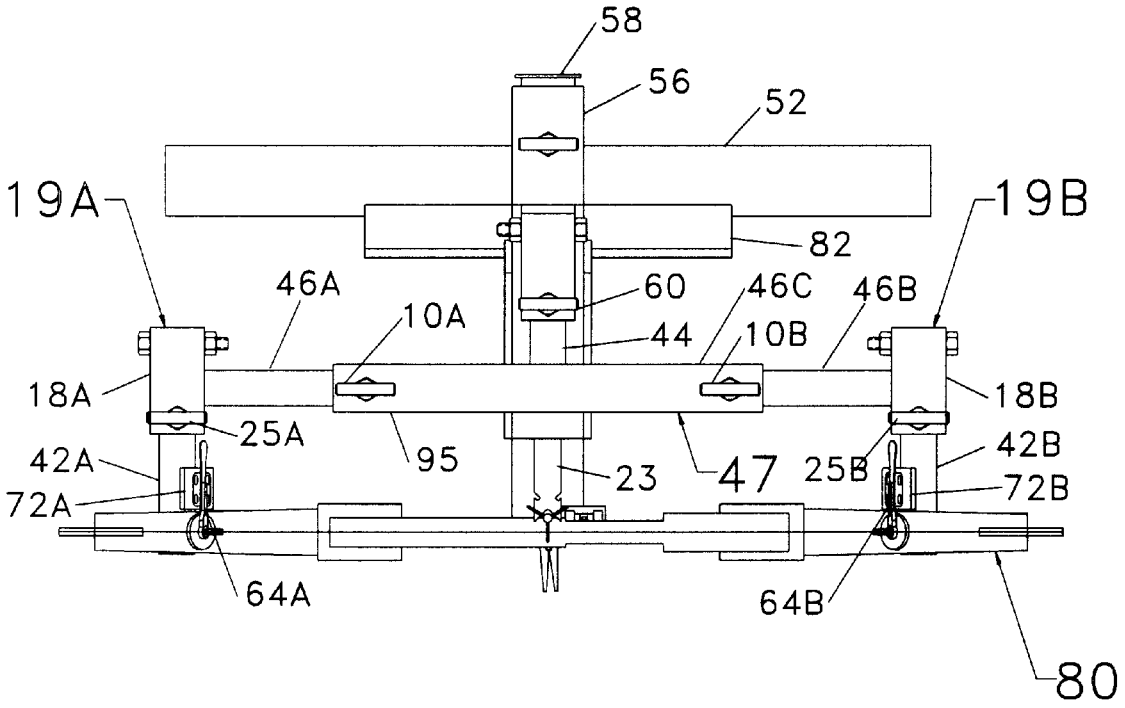
FIG. 1C is a top view of the invention illustrating a bow and arrow attached.

Turning now to the Figs., FIGS. 1A–1C show a variety of views of the bow mount 100. The bow mount includes a support member 56, a frame member 47 attached to the support member 56, and two clamping arms 18A, 18B, each of which is attached to the frame member 47. The frame member 47 has a front side 95 and the two clamping arms 18A, 18B extend laterally from the front side 95 of the frame member 47.

The support member 56 may include a variety of parts which comprise the preferred embodiment of the bow mount 100, as best seen in FIG. 1B. The support member 56 is attached to the top 49 of a main vertical support brace 48. The bottom end 51 of the main vertical support brace 48 is attached to horizontal support braces 52, 54. The support pads 50 are attached to each end 61 of the horizontal support braces 52, 54. The support braces are preferably made of metal and are preferably attached to each other by welding.

An alternative embodiment not shown in the drawings but contemplated to be within the scope of the invention is for the bottom end 51 of the main vertical support brace 48 to be attached directly to a work surface, such as a table or work bench. Alternatively, the support member 56 may be attached directly to a work surface. In either of these two alternative configurations, the work surface and its supporting members, such as legs, may be considered to form part of the support member 56, for reasons which will become apparent in later parts of the application. Many alternative configurations are possible and will be apparent to one of ordinary skill in the art from the description of the present invention; these configurations are also intended to fall within the scope of the invention.

The frame member 47 is rotatably attached to the support member 56. The preferred configuration is shown most clearly in FIGS. 2A–2C. In the preferred embodiment, the frame member 47 includes an inner tubular support brace 58 and the support member 56 includes an outer tubular support brace 63. The inner and outer tubular support braces 58, 63 comprise a first pair of mounting members. The first pair of mounting members 58, 63 have mating surfaces 65, 67 which are cylindrical, resulting in a circular cross-section. The first pair of mounting members 58, 63 permit the mounting member 58 to rotate around the shared axis 68 of each of the mounting members 58, 63.

The mounting members 58, 63 are configured to receive a first clamp which is capable of securing the first pair of mounting members 58, 63 to each other. In the preferred embodiment, the first clamp includes a number of parts. The first clamp preferably includes a hole 70 drilled in one mounting member 63, a steel nut 53 attached to the mounting member 63 surrounding the hole 70, and a locking bolt 62 threaded through the steel nut 53 which, when fully inserted and locked in place comes into contact with the outer surface 65 of the mounting member 58 and prevents the mounting member 58 from rotating with respect to the mounting member 63.

There are many alternative embodiments for the first pair of mounting members 58, 63 which are not shown in the drawings, but are contemplated by the inventor. One includes a ball and socket-type configuration or a spherical bearing with a spherical socket. An alternative clamping arrangement may include a pin which passes through holes in each of the pair of mounting members. A variety of other configurations and the use of other, more conventional types of clamps are possible and these modifications will be apparent to one of ordinary skill in the art from the description of the preferred embodiment; these configurations are intended to fall within the scope of the invention.

Figure 3A:
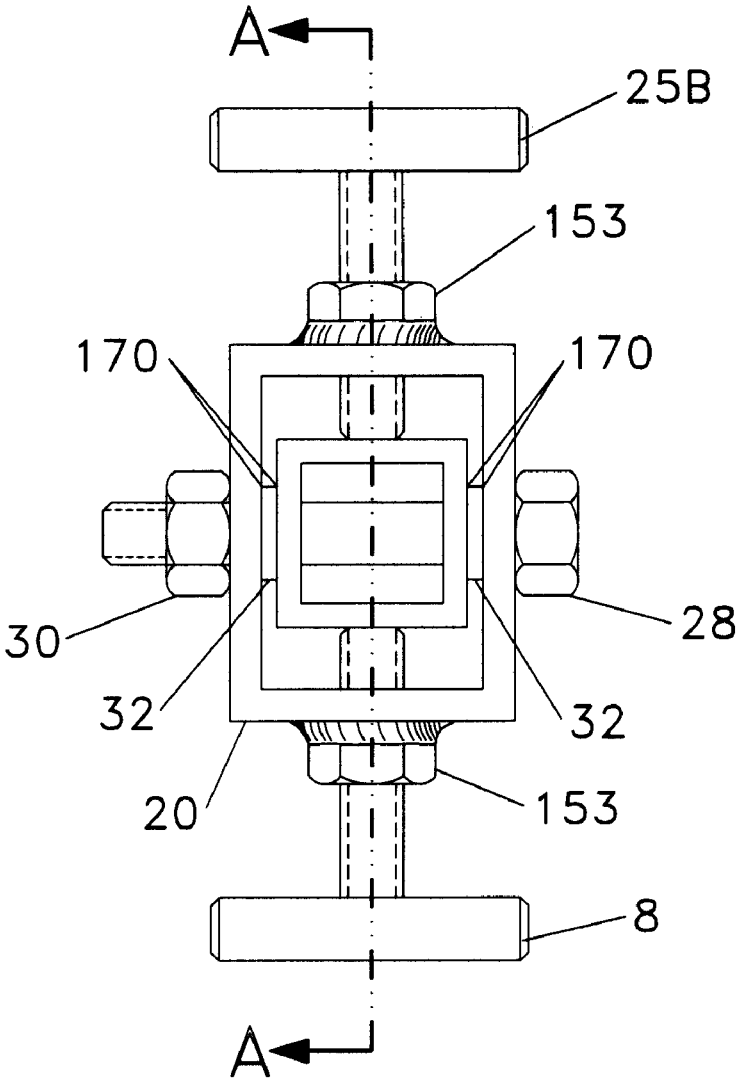
FIG. 3A is an end view of a preferred embodiment of the second pair of mounting members.
Figure 3B:
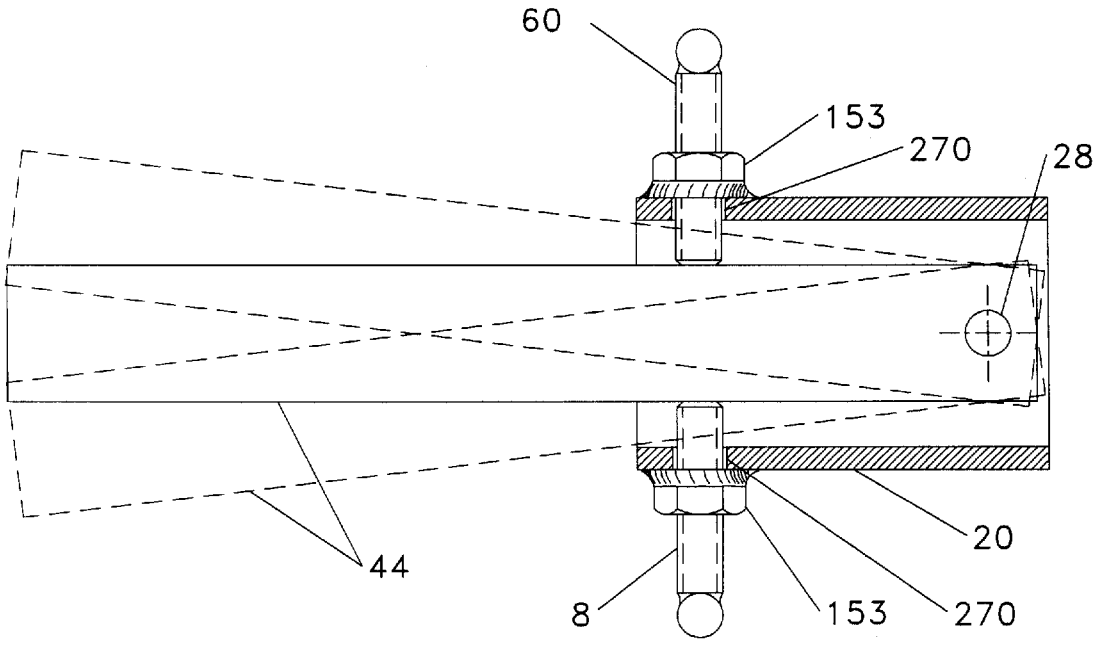
FIG. 3B is a sectional view taken along line A—A in FIG. 3A of a preferred embodiment of the second pair of mounting members.
Figure 3C:
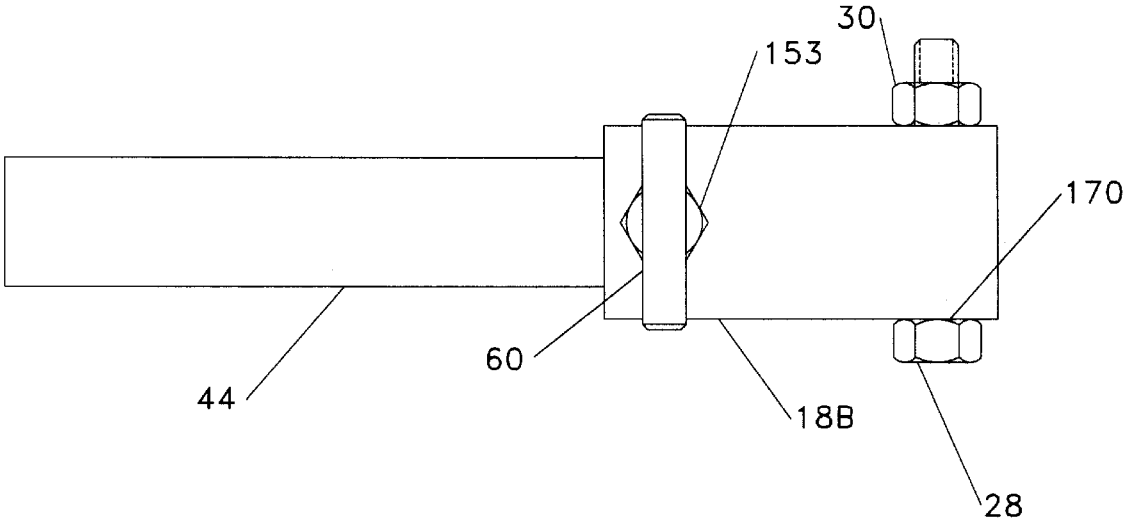
FIG. 3C is a top view of a preferred embodiment of the second pair of mounting members.

The frame member 47 is preferably also tiltably attached to the support member 56. The preferred embodiment of the second pair of mounting members 44, 20 (which allow the tilting) is shown in detail in FIGS. 3A–3C. FIGS. 3A–3C show only the detail of the second pair of mounting members 44, 20 and do not include the attachment of the members 44, 20 to the remainder of the bow mount 100.

The preferred embodiment of the second pair of mounting members 44, 20 includes an inner rectangular support brace 44 and an outer rectangular support brace 20, each of which are rectangular in cross section. A horizontal hole 170 is drilled through each of the second pair of mounting members 44, 20. In the preferred embodiment shown in the Figs., the second pair of mounting members 44, 20 are attached to each other, preferably with a steel bolt 28 and a steel nut 30 extending horizontally through both members 44, 20, forming a hinge. Steel washers/spacers 32 are used between the two mounting members 44, 20 to form a space between them.

In order to perform the tilting operation, in a preferred embodiment shown in the Figs., steel nuts 153 are welded over two additional holes 270 drilled through each of the top and the bottom of the outer rectangular support bracket 20. An adjustable leveling bolt 8 is threaded into one of the steel nuts 153 and a locking bolt 60 is threaded into the other of the steel nuts 153. Adjustment of the leveling bolt 8 and the locking bolt 60 tilts and locks, respectively, the mounting members 44, 20 with respect to each other and therefore causes tilting of the frame member 47 with respect to the support member 56. The leveling bolt 8 and the locking bolt 60 serve as a second clamp which may secure the mounting members 44, 20 to each other by tightening each of the bolts 8, 60 until each comes into contact with the inner rectangular support brace 44. A variety of other configurations are possible and will be apparent to one of ordinary skill in the art; these configurations are intended to fall within the scope of the invention.

In the embodiment shown in the Figs., only the first and second pairs of mounting members 44, 20 and 58, 63 are shown between the support member 56 and the frame member 47. It will be apparent to one of ordinary skill in the art that these mounting members may have a variety of lengths and widths to accommodate a particular work area or a variety of bow sizes. Additionally, other pieces may be inserted between the support member 56 and the frame member 47 which will give additional space between the support member 56 and the frame member 47. This additional space may be desirable in certain work spaces or for certain types and sizes of bows. The addition of other pieces should be considered to form part of the present invention.

It is also contemplated, but not preferred, that the first and second pairs of mounting members 44, 20 and 58, 63 could be combined into one set of mounting members. Such a configuration would require that there be a ball and socket type arrangement or some other mounting member which might include a circular cross section and a rectangular cross section to allow for both rotation and tilting. In such a case, the structures which are used to allow the tilting and rotating should be considered to fall within the terms "first pair of mounting members" and "second pair of mounting members" and be equivalent thereto, even though that configuration of mounting members may not have two separate and distinct pairs as with the preferred embodiment.

Attached to one of the mounting members 44, 20, as stated above, is a frame member 47. In the preferred embodiment shown in the Figs., the frame member 47 is a straight bar. However, the frame member 47 may be curved or have bent sections at its ends.

The frame member 47 has a front side 95. The front side 95 is generally the side of the frame member 47 which is away from the support member 56 and the side of the frame member 47 on which the bow is mounted. The frame member 47 may be longitudinally adjustable to accommodate different bows. The frame member 47 may include a plurality of longitudinal beams 46A, 46B, shown in FIGS. 1A and 1C, which are slidably attached, in the manner of a telescoping structure, to a central longitudinal beam 46C. The Figs. show only one longitudinal beam 46A, 46B on each side of the central longitudinal beam 46C, but it is apparent that each longitudinal beam 46A, 46B may be configured to slidably attach to other longitudinal beams and that the number of longitudinal beams need not be equal on each side of the longitudinal beam 46C. However, each longitudinal beam is preferably slidably attached to at least one other longitudinal beam.

Figure 2A:
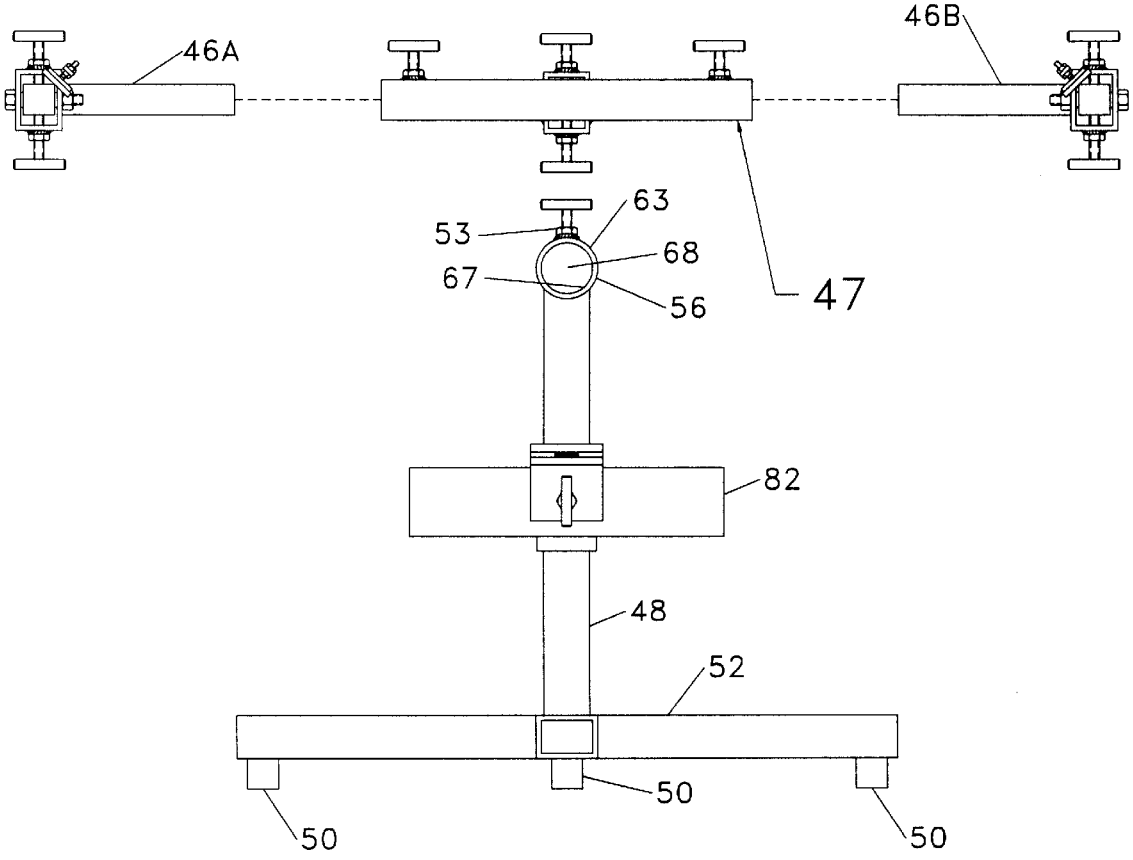
FIG. 2A is a front view of the invention illustrating the device partially disassembled.
Figure 2B:
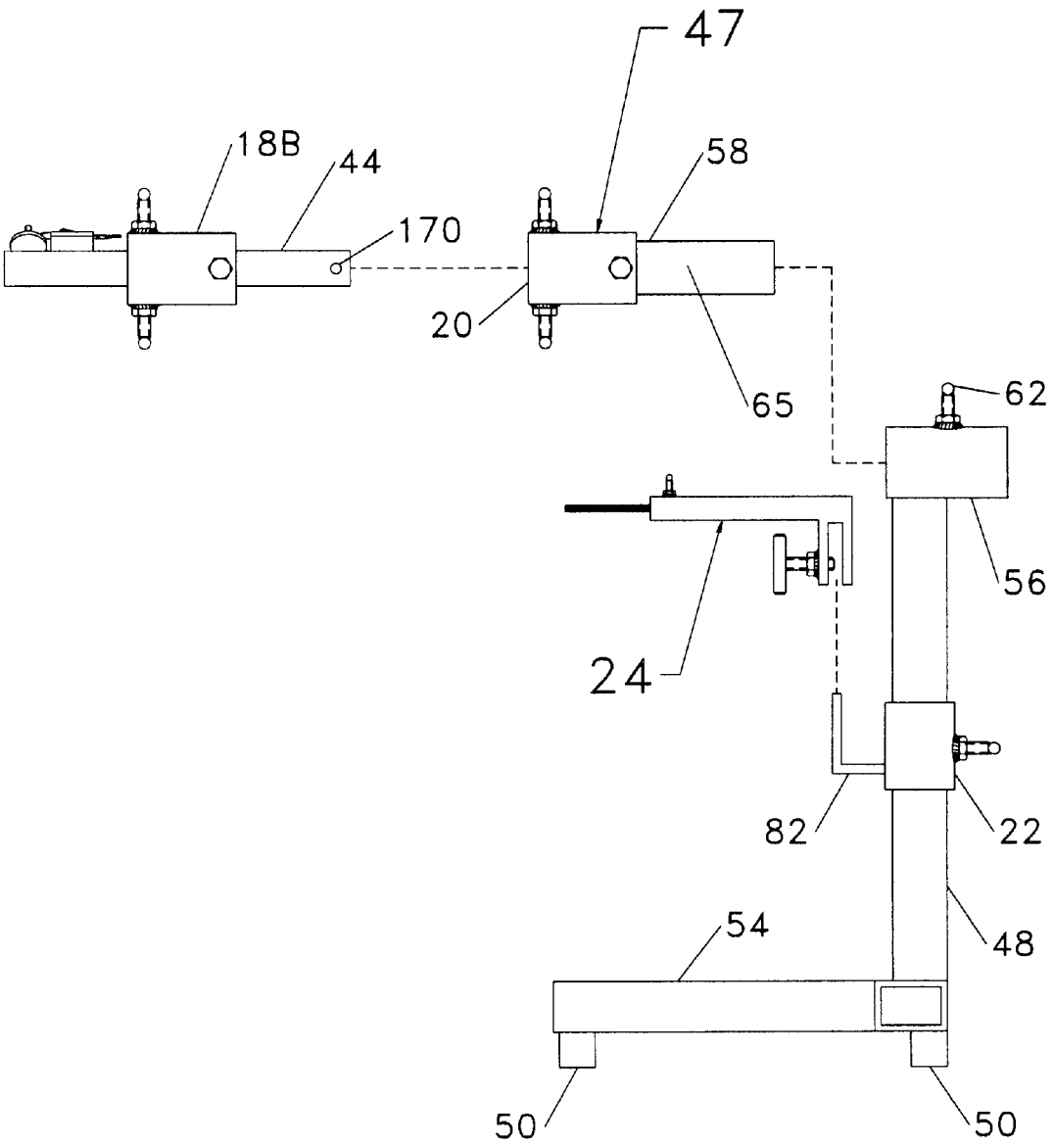
FIG. 2B is a side view of the invention partially disassembled.
Figure 2C:
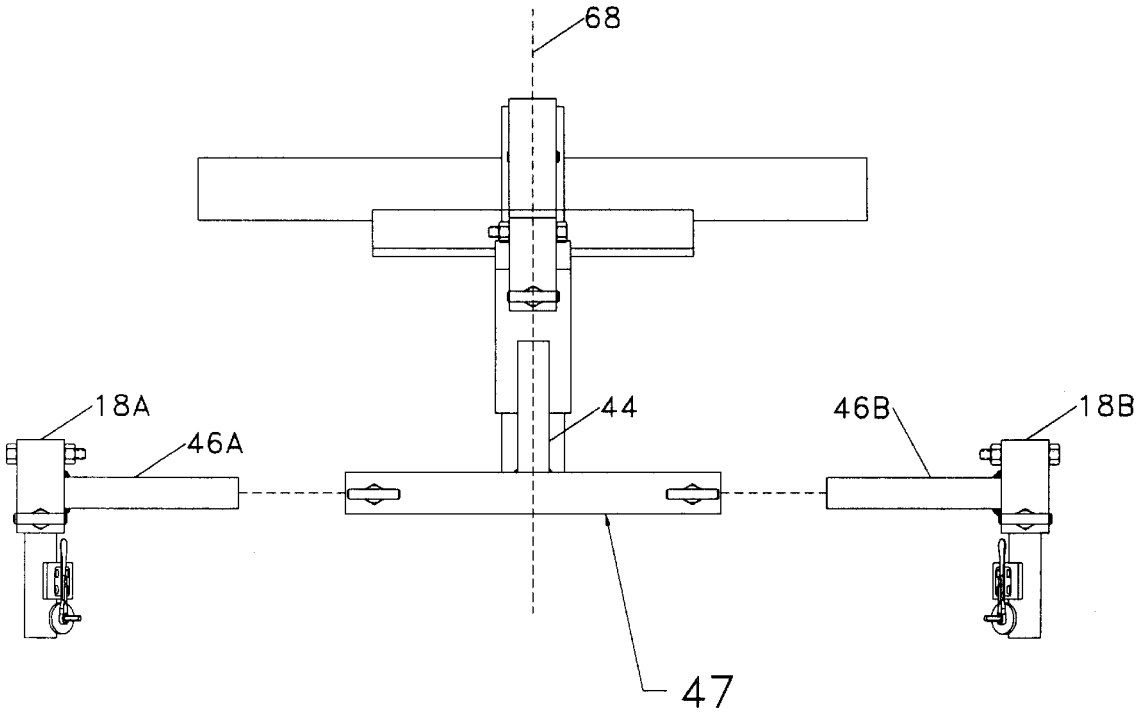
FIG. 2C is a top view of the invention partially disassembled.

The preferred mechanism for securing the longitudinal beams to each other is the locking bolts 10A, 10B, which pass through holes in the beams, in a similar fashion to that described earlier with respect to the first pair of mounting members 58, 63 and shown in FIGS. 2A and 2B. However, any other clamp known in the art may be used to attach one longitudinal beam to another.

A first clamping arm 19A and a second clamping arm 19B are each attached to the frame member 47. The preferred embodiment of the clamping arms is best shown in FIGS. 1A–1C. The preferred structure for each of the clamping arms 19A, 19B is similar to the preferred structure of the second pair of mounting members 44, 20 shown in FIGS. 3A–3C. The clamping arm 19A includes an inner limb leveling brace 42A and an outer limb leveling brace 18A, each of which are rectangular in cross section. A hole is drilled through each of the limb leveling braces 18A, 42A. The limb leveling braces 18A, 42A are bolted together with a horizontal steel bolt and a steel nut in a manner similar to the members shown in FIGS. 3A–3C to form a hinge. Steel washers/spacers are used between the limb leveling braces 18A, 42A.

Steel nuts are welded over additional holes drilled through each of the top and bottom of the outer limb leveling brace 18A. An adjustable leveling bolt 41A is threaded through the lower of the steel nuts and a locking bolt 25A is threaded through the upper of the steel nuts. Adjustment of the leveling bolt 41A and the locking bolt 25A permit the leveling braces 18A, 42A to tilt with respect to each other as described with respect to the structure shown in FIGS. 3A–3C. The leveling bolt 41A and locking bolt 25A serve as a clamp which may secure the leveling braces 18A, 42A to each other by tightening each of the bolts until each comes into contact with the inner rectangular support brace 42A.

In the preferred embodiment, a mounting plate 72A is attached to the rectangular support brace 42A and a bow locking clamp 64A is attached to the mounting plate 72A. These pieces cooperate to clamp a limb of a bow. The second clamping arm 19B is a mirror image of the first clamping arm 19A and includes the same components configured in a similar way.

The precise configuration of the clamping arms 19A, 19B need not be identical to that shown in the Figs. or discussed above in order to accomplish the objectives of the present invention. However, there are some qualities that the clamping arms should have. First, the clamping arms 19A, 19B must each extend laterally from the front side 95 of the frame member 47. This lateral extension is important so that an arrow can be attached to a bowstring on a bow and a user may manipulate the arrow and bow, as will be explained in detail below. In addition, the clamping arms 19A, 19B must be spaced from each other in order that each clamping arm may clamp a limb of a bow. In order for the bow to be adjusted properly, each limb of the bow must be stabilized in order to effectively tune the bow. If the clamping arms 19A, 19B have these properties, they come within the scope of the invention, even if they are as simple as a C-clamp welded to each end of the frame member 47.

Figure 4A:
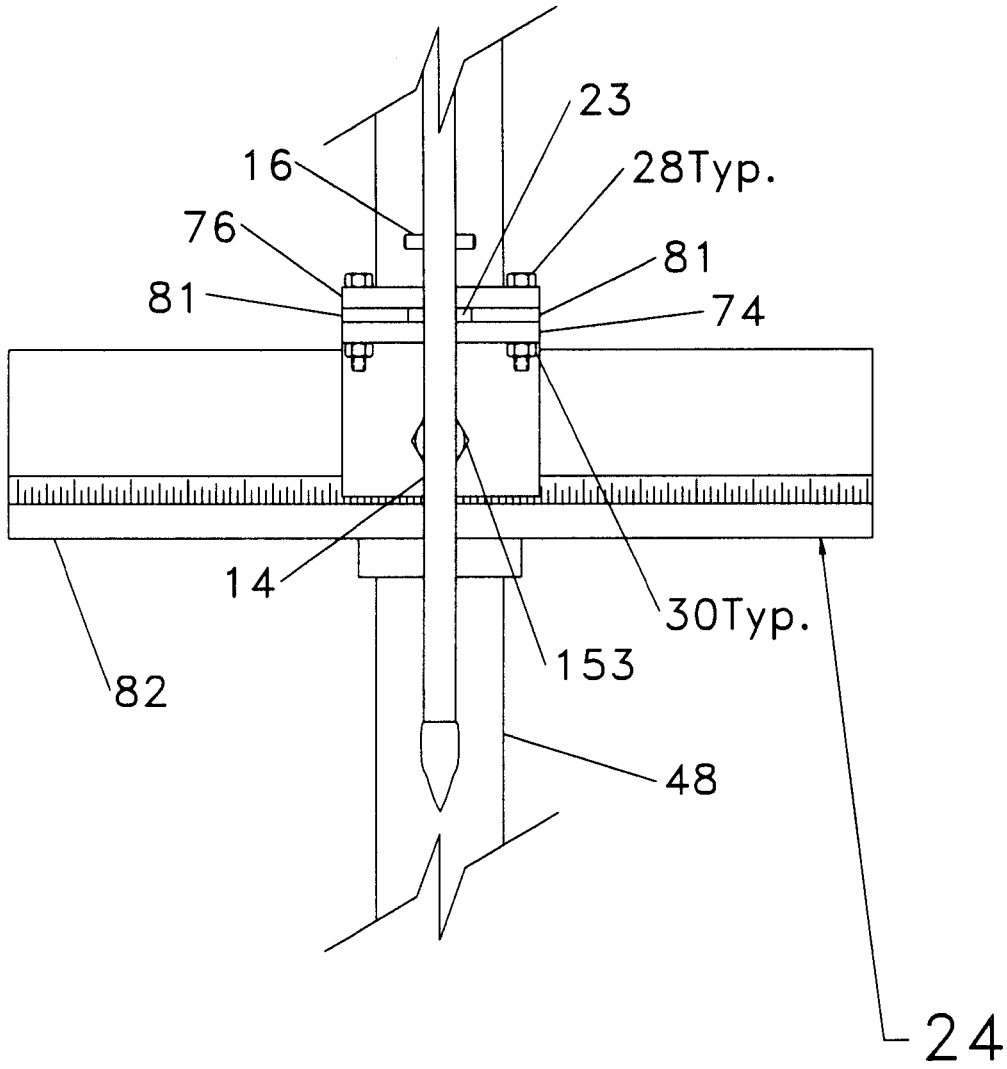
FIG. 4A is a detailed front view of the arrow stabilizer.
Figure 4B:
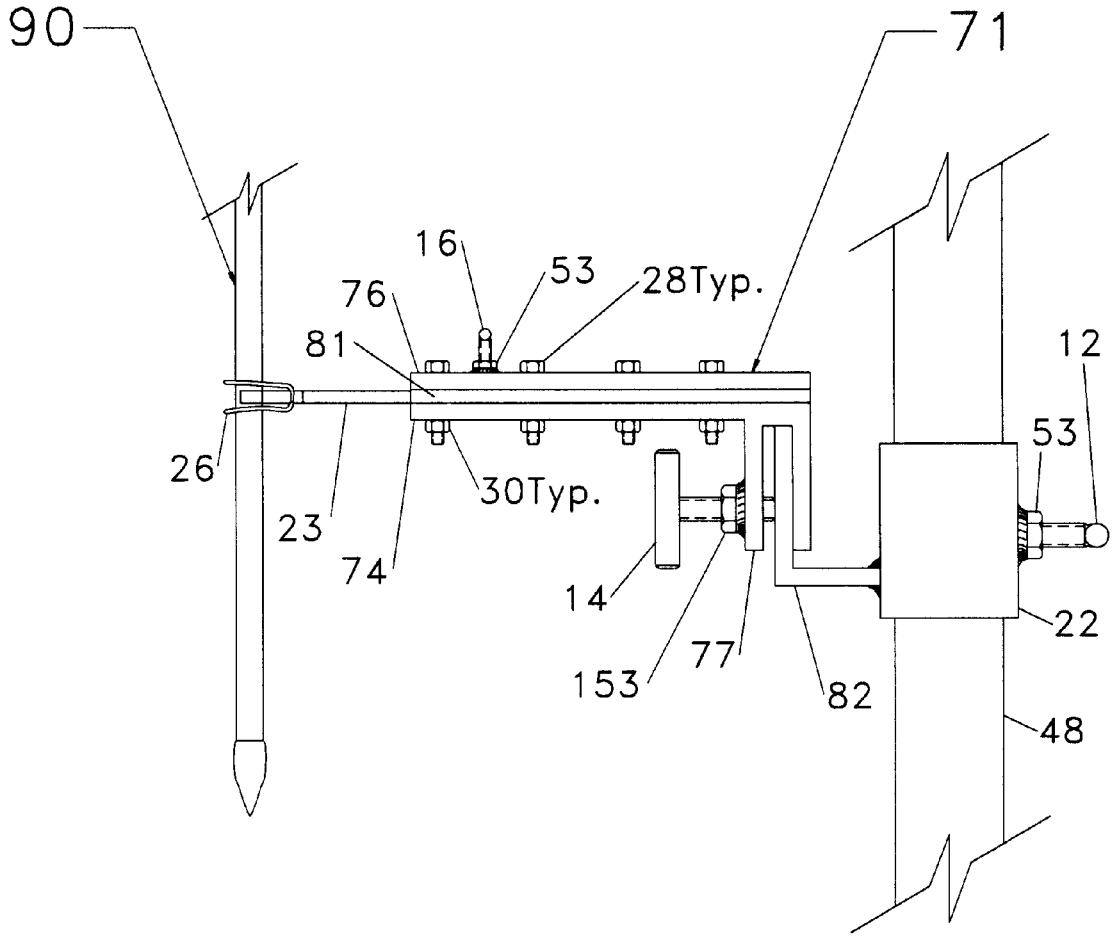
FIG. 4B is a detailed side view of the arrow stabilizer.
Figure 4C:
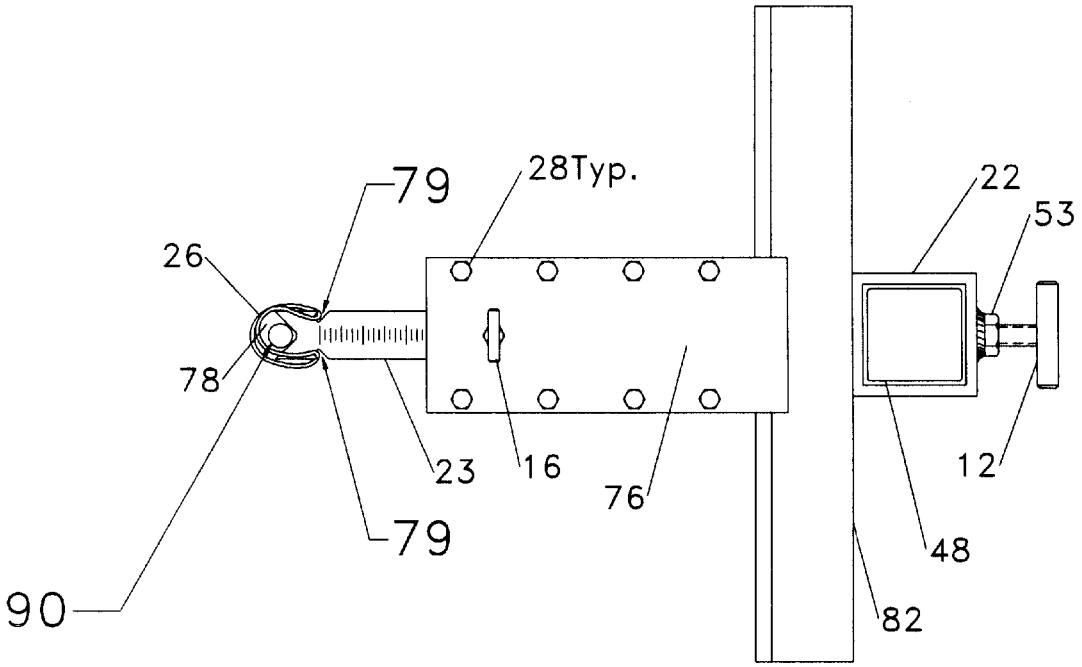
FIG. 4C is a detailed top view of the arrow stabilizer.

In performing the process of tuning the bow to be described in detail later, it is important that an arrow used in the tuning procedure be stabilized with respect to a bow. Thus, the bow mount 100 should include an arrow stabilizer 24, the preferred embodiment of which is shown in detail in FIGS. 4A–4C. The arrow stabilizer 24 is preferably slidably attached to the main vertical support brace 48 by a vertically adjustable collar 22. Rigidly attached to the collar 22 is a horizontal, preferably steel, bracket 82. The bracket 82 may include a gauge for determining the correct position of an arrow, as will be described in detail below. Slidably attached to the bracket 82 is a body 71. The body 71 slides laterally with respect to the bracket 82, particularly if the bracket 82 includes a gauge, so that the arrow may be accurately positioned.

The body 71 includes a lower plate 74 with eight holes drilled through the top section and one drilled hole in a side plate 77. A locking bolt 14 is threaded through a steel nut which has been welded over the drilled hole in the side plate 77. Two spacers 81 with four holes drilled in each, are placed on top of the lower plate 74, one on each side. Placed on top of the spacers 81 is a top plate 76 with nine holes drilled in it. Eight steel bolts 28 and steel nuts 30 are used to bolt the top plate 76, spacers 81 and body 74 together. A locking bolt 16 is threaded through the steel nut welded over the remaining hole in the top plate 76. A holder 23 is slidably mounted between the spacers 81, top plate 76 and the lower plate 74. The holder 23 extends at least as far as the locking bolt 16 and is permitted to slide inwardly and outwardly and may also rotate slightly within the gap formed by the lower plate 74, the spacers 81, and the top plate 76. The locking bolt 16 is capable of securing the holder 23 and the plates with respect to each other.

A centering v-notch 78 is formed in the end of the holder 23. A holding notch 79 is formed on each side of the holder 23. A rubber band 26 is preferably used to secure an arrow 90 within the centering v-notch 78. This preferred embodiment of the arrow stabilizer 24 includes a variety of parts, but important qualities of the arrow stabilizer are that the body 71 is slidably attached to the bracket 82 and that the plates 74, 76 and holder 23 are slidable with respect to each other. Other configurations are possible for the arrow stabilizer within those parameters.

When the support member 56 is directly attached to a work surface, the arrow stabilizer 24 may be attached to a leg or other portion of the work surface below the support member 56 for holding the arrow. Such a configuration should be viewed as coming within the scope of the invention.

The apparatus of the invention has been described in detail. We turn now to the various steps and various processes which a person can carry out on a bow when it is placed in the bow mount 100 of the invention. Not all of these steps are essential, but all may be performed on a bow mounted on the earlier-described bow mount 100. The placement of the various pieces not described above may be best seen in FIGS. 5A–5C.

To enable accurate shooting, a number of elements of bow 80 should be in line or balanced for top performance. Referring to FIGS. 1A–1C, a bow 80 can be checked for limb twist or fit by first placing the bow 80 evenly onto the first and second clamping arms 19A, 19B. The space between the first and second clamping arms 19A, 19B can be adjusted to fit different sizes of bows 80. First, bolts 10A, 10B are loosened and the longitudinal beams 46A, 46B are slid in or out until the proper position is obtained. After the longitudinal beams 46A and 46B are positioned, the bolts 10A and 10B are tightened.

The locking bolt 62 should then be tightened enough to support bow 80, but left loose enough to allow rotation of the inner tubular support brace 58 with respect to the outer tubular support brace 63 when pressure is applied to one side of the bow 80 or one side of the frame member 47.

The inner leveling braces 42A, 42B on the clamping arms 19A, 19B should be positioned in the centers of the outer limb leveling brackets 18A, 18B to allow for vertical adjustments if needed. One of the limbs 15A, 15B of the bow 80 is secured to the bow mount 100 using one of the locking clamps 64A, 64B. The corresponding locking bolt 25A or 25B should then be tightened. Next, the corresponding leveling brace 42A, 42B should fit flat against the bottom of the second limb 15A, 15B. If there is a gap between the brace 42A, 42B and the second limb 15A, 15B, the leveling bolt 41A, 41B and the locking bolt 25A, 25B are adjusted until the brace 42A, 42B fits flush against the second limb 15A, 15B. The second locking bolt 25A, 25B is then tightened down. Next, the other locking clamp 64A, 64B is clamped to secure the other bow limb.

Figure 5A:
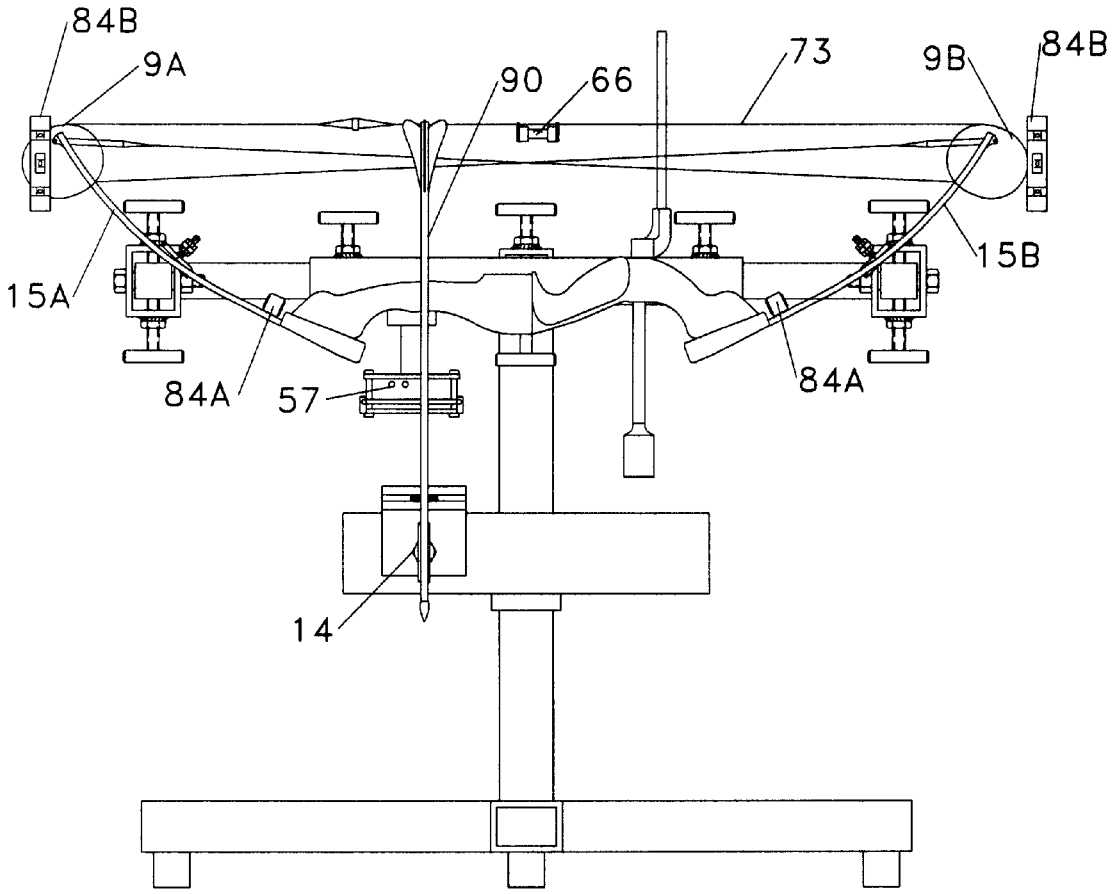
FIG. 5A is a front view of the invention being used to align the sight pins and to show the placement of the levels.
Figure 5B:
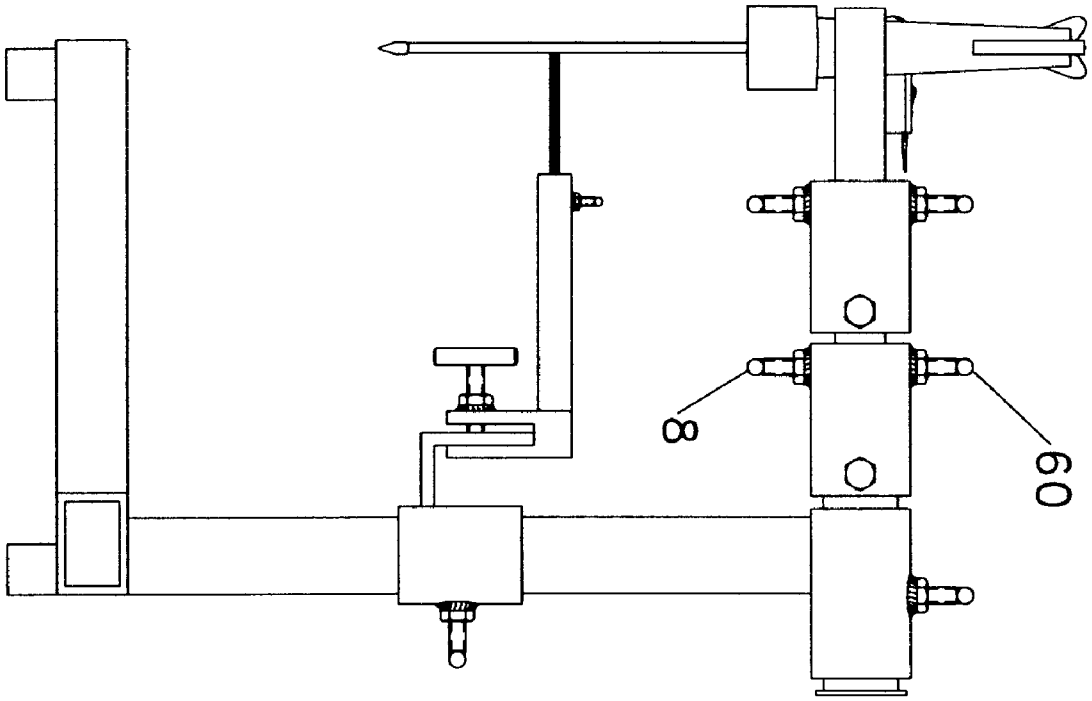
FIG. 5B is a side view of the invention being used to align the sight pins.

A first level 66 is placed on or attached to the bow string 73 on the bow 80 as shown in FIG. 5A. Pressure is applied to one side of the bow 80 or to one side of the frame member 47 until the frame member 47 rotates relative to the support member 56 and the level 66 indicates a level condition. The locking bolt 62 is tightened to prevent the first pair of mounting members 58, 63 from turning with respect to each other, and to prevent the support member 56 and the frame member 47 from turning with respect to each other.

The second and third levels 84A are placed on the limbs 15A, 15B of the bow 80. With bolt 60 loose, the bolt 8 is adjusted to tilt the frame member 47 with respect to the support member 56 until one of the levels 84A indicates a level condition. The relative twist (if any) between the limbs 15A and 15B is checked by reading the two levels 84A. If there is a difference and it is only minimal, the difference is split by adjusting the bolt 8 while watching the levels 84A. If there is only a minimal difference between the level condition between the two limbs 15A, 15B of the bow 80 and the difference is split, this condition constitutes the second level and third level indicating essentially level conditions. Further repair or replacement of different parts of the bow 80 may be necessary if the difference between the level condition of the second and third levels 84A is significant, but these repairs do not fall within the scope of this process. Next the bolt 60 is tightened so the frame member 47 and the support member 56 cannot tilt with respect to each other.

Figure 5C:
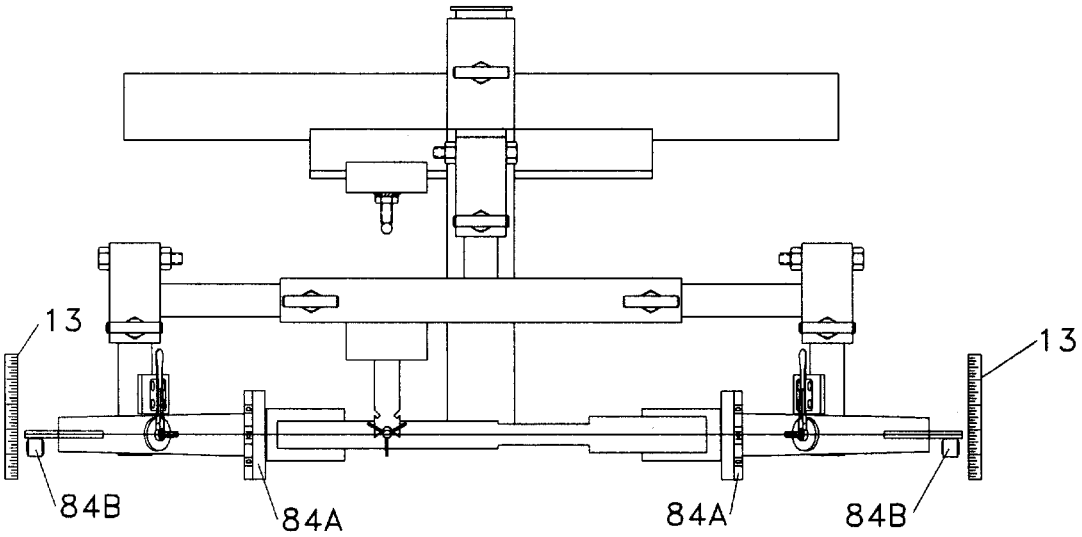
FIG. 5C is a top view of the invention being used to align the sight pins and to show the placement of the levels and gauges.

The bow 80 is a compound bow, and therefore the eccentrics 9A, 9B should be aligned with each other. Obviously, a bow without eccentrics will not have this alignment step performed. First, the distance between the side of each limb 15A, 15B and the center of the eccentrics 9A, 9B is measured with a ruler 13 as shown in FIG. 5C. The measurement should be equal if the limbs 15A, 15B have the same dimensions. If the measurement is significantly different, repair or replacement of the bow 80 or the eccentrics 9A, 9B may be necessary. Again, these repairs do not form a part of the present process. Next, the levels 84B are placed against the eccentrics 9A, 9B and any differences between the angle of the eccentrics 9A, 9B should be noted. If a slight angle difference is found between the eccentrics 9A, 9B, the bolt 60 is loosened and the bow 80 is again tilted until the difference is split between the eccentrics 9A, 9B. The bolt 60 is again tightened to prevent movement of the bow 80. If the difference between the eccentrics 9A and 9B is significant, repair or replacement outside the scope of this process may be necessary.

Once the bow 80 has been checked for alignment, the operator can proceed with setting the nocking point, finding the center shot, and installing an arrow rest 99. The first level 66 attached to the bowstring 73 is checked to make sure it still indicates a level condition. If level, an arrow 90 is attached to the bowstring 73 close to the arrow shelf or where an arrow rest will be installed. Referring to FIGS.

4A–4C, the bolt 12 on the arrow stabilizer 24 is loosened and the collar 22 is adjusted by lifting or lowering by hand. Once the collar 22 is in the desired position, the bolt 12 is tightened. The bolt 14 and the bolt 16 are then loosened so that the body 71 can slide with respect to the bracket 82 and the arrow holder 23 can slide with respect to the plates 74, 76. The body 71 and the holder 23 are adjusted so the arrow 90 can be attached in the v-notch 78 in the holder 23. The arrow 90 is preferably secured in the v-notch 78 by a rubber band 26 wrapped around the arrow 90 and hooked in the two notches 79.

Figure 6A:
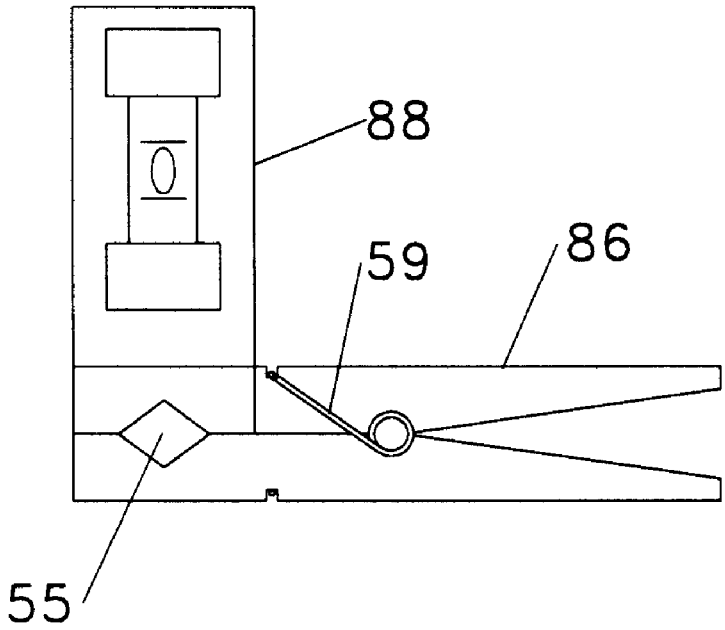
FIG. 6A is a front view of a preferred embodiment of the fourth level.
Figure 6B:
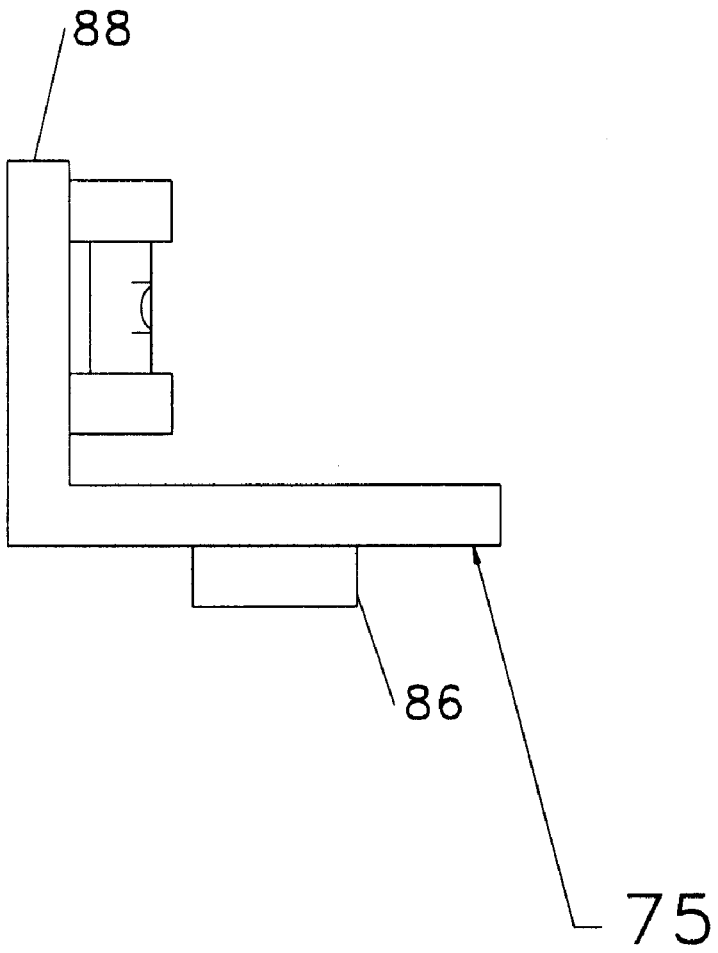
FIG. 6B is a side view of a preferred embodiment of the fourth level.
Figure 6C:
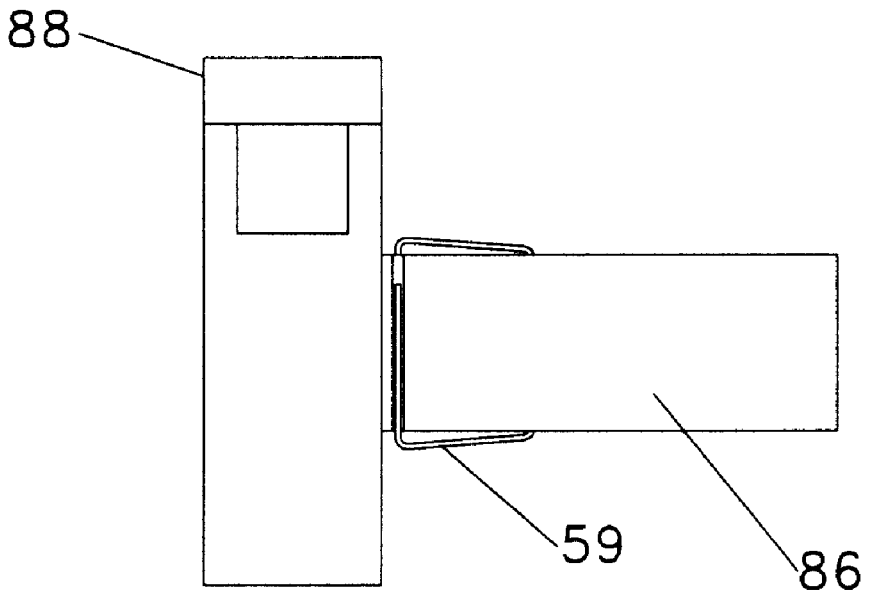
FIG. 6C is a top view of a preferred embodiment of the fourth level.

The arrow leveling device 75, shown in detail in FIGS. 6A–6C, is attached to the arrow 90 by opening the clamp 86 by pressing the ends of the clamp 86 together. The v-notches 55 are placed over the arrow 90, then the ends of clamp 86 are released, allowing the spring 59 loaded clamp 86 to hold firmly to the shaft of the arrow 90. The arrow leveling device 75 automatically orients the fourth level 88 perpendicular with the arrows 90. The body 71 and the holder 23 are then adjusted until the fourth level 88 indicates a level condition. The bolts 14, 16 are then tightened.

For a bow 80 with a shoot-through rest 99, the arrow 90 can stay in this position for a perfect center shot. For a bow 80 with a shoot-around rest 99 or the shelf, a slight offset from center shot is usually needed. If an offset is needed, the bolt 16 is loosened and the holder 23 is moved to the desired position, then the bolt 16 is tightened.

To find the correct nocking point, the leveling device 75 is turned so the fourth level 88 is in the same horizontal plane as the bow 80. The body 71 is then slid with respect to the bracket 82 by hand until the fourth level 88 indicates a level condition. A user then sights down the arrow 90 to make sure the clearance is adequate. If the arrow 90 requires more clearance, the arrow 90 is slid in direction needed and the body 71 is readjusted. Once the proper location is determined, the bolt 14 is tightened. A nock set is then attached to the bowstring 73 above arrow 90. The location of the nockset 21 varies from each bow 80 because of various setups and variables in the equipment. Normally the distance the nockset 21 is positioned above the arrow 90 is from one-eighth to one-half inch.

Once the center shot and nocking point are set, the arrow rest 99 can be installed and adjusted to the arrow 90. If the bow 80 is set up to shoot off the shelf, moleskin or leather can be used to build up to the arrow 90.

To align the sight pins 57 with the centershot adjustment, the arrow 90 is detached from the bowstring 73 and the bolt 14 is loosened. The body 71 with the arrow 90 attached is slid in the direction that will substantially line up the center of the arrow 90 with the sight pins 57. The arrow 90 is then secured again to the bowstring 73 and the bolt 14 is tightened. The pins 57 are then adjusted until they are centered with the arrow 90.

The rubber band 26, the first level 66, and the arrow 90 are then removed from the bow 80. The bow 80 can then be turned anywhere from a horizontal position to a vertical position. The bolt 14 is then loosened and the body 71 removed. The bolt 62 is loosened and the frame member 47 and the bow 80 are allowed to turn to a desired position. The bolt 62 is then tightened. Other accessories can be installed on the bow 80 if needed.

For the fine tuning of a bow 80 and arrow 90, any standard test may be used to evaluate the alignment of the various parts of the bow 80. An arrow 90 may be shot from the bow 80 while the bow 80 is still mounted in the bow mount 100. After the arrow is shot, a user may find that some additional adjustments need to be made. If a user finds that a nocking point and centershot adjustment will have to be made, various adjustments to the centerpoint, the nocking point, the position of the arrow rest, and the alignment of the sight pins can be made in a way similar to that described above. To make a nocking point adjustment, the bolt 14 is loosened and the body 71 moved to the desired position while using the gauge on the bracket 82 as a reference. To adjust the centershot, the bolt 16 is loosened and the holder 23 is moved to the desired position using the gauge on holder 23 as a reference. The standard test may again be used to determine if additional fine tuning is required.

Other pieces of equipment may also be attached to and used in connection with the present invention. For example, a portable bow press or a hydraulic or vice apparatus could be used with the present bow mount to assist a user with replacing a bowstring. In addition, standard tools for separating the bowstring from the cable or servers may also be used in connection with the present invention.

While certain preferred embodiments of the present invention have been disclosed in detail, it is to be understood that various modifications may be adopted without departing from the spirit of the invention or scope of the following claims.

I claim:

1. A bow mount, comprising:

a support member;

a frame member rotatably mounted to said support member, said frame member having a front side;

a first clamping arm mounted to said frame member and extending laterally from said front side of said frame member for clamping a limb of a bow; and a second clamping arm mounted to said frame member, spaced from said first clamping arm, and extending laterally from said front side of said frame member for clamping another limb of said bow.

2. The bow mount according to claim 1, wherein said frame member is tiltably mounted to said support member.

3. The bow mount according to claim 1, wherein each said clamping arm is tiltably mounted to said frame member.

4. The bow mount according to claim 1, further comprising a first pair of mounting members mounted between said frame member and said support member, each said mounting member having a circular cross-section, and allowing for a rotation about the center of each of said mounting members and further comprising a first clamp capable of securing said mounting members to each other.

5. The bow mount according to claim 4, further comprising a second pair of mounting members mounted between said frame member and said support member, each of said second pair of mounting members having a rectangular cross-section, and allowing for a tilting of said frame member with respect to said support member, and further comprising a second clamp capable of securing said second pair of mounting members to each other.

6. The bow mount according to claim 1, further comprising an arrow stabilizer slidably attached to said support member, said arrow stabilizer being capable of receiving an arrow.

7. The bow mount according to claim 6, wherein said arrow stabilizer comprises a bracket and a body, said bracket being slidably attached to said body.

8. The bow mount according to claim 7, wherein said body comprises a plate and a holder, said plate being slidably attached to said holder, and further comprising a third clamp capable of securing said plate and said holder with respect to each other.

9. The bow mount according to claim 7, wherein said bracket comprises a gauge for determining a correct position for an arrow received in said body.

10. The bow mount according to claim 1, wherein said frame member comprises a plurality of longitudinal sections, each of said longitudinal sections being slidably attached to at least one other said longitudinal section.

11. A process for tuning a bow, comprising:

(a) securing a bow in two clamping arms, said clamping arms being mounted to a frame member, said clamping arms extending laterally from a front side of said frame member, said frame member being tiltably and rotatably mounted to a support member;

(b) placing a first level on a bowstring on said bow;

(c) rotating said frame member with respect to said support member until said first level indicates a level condition;

(d) securing said frame member to said support member to prevent the rotation of said frame member with respect to said support member;

(e) placing a second level and a third level on said bow;

(f) tilting said frame member with respect to said support member until said second level and said third level each indicate a level condition;

(g) securing said frame member to said support member to prevent tilting of said frame member with respect to said support member;

(h) attaching an arrow to said bowstring;

(i) attaching said arrow to an arrow stabilizer, said arrow stabilizer being slidably attached to said support member, wherein said arrow stabilizer comprises a bracket and a body, said body comprising a plate and a holder, said holder and plate being slidably attached, and further comprising the step of sliding said holder with respect to said plate until said fourth level indicates a level condition;

(j) attaching a fourth level to said arrow;

(k) attaching an arrow rest to said bow, said arrow rest being also in contact with said arrow;

(l) detaching said arrow from said bow string and sliding said body until said arrow is substantially in line with sight pins attached to said bow;

(m) again securing said arrow to said bow string; and (n) adjusting said sight pins until said sight pins are centered with said arrow.

* * * * *